US007100745B2

(12) United States Patent
Bisang et al.

(10) Patent No.: US 7,100,745 B2
(45) Date of Patent: Sep. 5, 2006

(54) EQUIPMENT AT AN ELEVATOR CAR FOR TEMPORARILY COUPLING A CAR DOOR LEAF WITH A SHAFT DOOR LEAF FOR ACTUATION OF A CAR DOOR UNLOCKING MEANS

(75) Inventors: Daniel Bisang, Baar (CH); Jürgen Lütolf, Cham (CH); Frank Thielow, Bodnegg (DE)

(73) Assignee: Inventio AG, Hergiswil (CH)

( * ) Notice: Subject to any disclaimer, the term of this patent is extended or adjusted under 35 U.S.C. 154(b) by 135 days.

(21) Appl. No.: 11/005,724

(22) Filed: Dec. 7, 2004

(65) Prior Publication Data

US 2005/0139429 A1 Jun. 30, 2005

(30) Foreign Application Priority Data

Dec. 8, 2003 (EP) ..... 03405874

(51) Int. Cl.
*B66B 13/12* (2006.01)

(52) U.S. Cl. ..... 187/319; 187/335; 187/330; 187/315

(58) Field of Classification Search ..... 187/319, 187/324, 330, 331, 335
See application file for complete search history.

(56) References Cited

FOREIGN PATENT DOCUMENTS

| | | |
|---|---|---|
| EP | 0 332 841 | 9/1989 |
| EP | 0 513 509 | 11/1992 |
| EP | 1266860 A1 * | 12/2002 |

* cited by examiner

*Primary Examiner*—Kathy Matecki
*Assistant Examiner*—Stefan Kruer
(74) *Attorney, Agent, or Firm*—Butzel Long

(57) ABSTRACT

Equipment for temporarily coupling an elevator car door leaf with a shaft door leaf and for actuating a car door lock includes a coupling mechanism arranged at the car door leaf with two entraining runners mounted on two pivotable adjusting elements. The spacing between the entraining runners can be adjusted by pivoting of the adjusting elements between an uncoupling setting and a coupling setting, wherein the entraining runners in the coupling setting cooperate with at least one coupling element mounted at the shaft door leaf. One of the entraining runners is coupled by way of a respective articulation member with one arm of each of the two adjusting elements, wherein a contact force arising between the entraining runner and the corresponding coupling element in the coupling setting causes the entraining runner to execute an additional movement which is guided by the articulation members to unlock the car door lock.

14 Claims, 4 Drawing Sheets

EQUIPMENT AT AN ELEVATOR CAR FOR TEMPORARILY COUPLING A CAR DOOR LEAF WITH A SHAFT DOOR LEAF FOR ACTUATION OF A CAR DOOR UNLOCKING MEANS

BACKGROUND OF THE INVENTION

The present invention relates to equipment at an elevator car for temporarily coupling a car door leaf with a shaft door leaf and for actuating a car door unlocking means. The present invention concerns the problem of allowing the opening movement of the elevator car door leaf only when the elevator car is disposed at the level of a floor, i.e. when the car door stands opposite a shaft door of the elevator.

A door drive device with a coupling mechanism for coupling a card door leaf with an associated shaft door leaf is shown in European Patent Specification EP 0 332 841. The coupling mechanism comprises two entraining runners which are oriented to be parallel to the travel direction of the elevator car and which are adjustable in their mutual spacing by a parallelogram guide with two adjusting elements each pivotable about a respective pivot axis. If the elevator car is correctly disposed at a floor level, the two entraining runners lie between two coupling elements arranged adjacent to one another at the shaft door leaf and can be laterally guided up to these (spread) in order on the one hand to unlock the shaft door leaf and on the other hand to transmit the opening and closing movement of the car door to the car door leaf in a play-free manner and synchronously. The adjustment of spacing between the two entraining runners in that case takes place by a door drive unit, which is fastened to the car door frame, by way of a linearly acting drive means (for example, by a belt drive), which also produces the closing and opening movements of the car door leaf. In that case the drive means so engages at the car door leaf by way of a pivot lever connected with the adjusting elements of the parallelogram guide that through the opening movement of the linearly acting drive means the adjusting elements are pivoted, before the start of a door leaf opening movement, into a setting in which the entraining runners are led up to the coupling elements, thereby unlock the shaft door leaf and form the coupling between the car door leaf and the corresponding shaft door leaf.

At the end of a door leaf closing movement the adjusting elements are pivoted by the closing movement of the linearly acting drive means back into a setting in which the entraining runners are spaced from the coupling elements so that the locking of the shaft door leaf in its locked position returns.

EP 0 332 841 additionally discloses equipment for unlocking the lock of a car door lock, which ensures that the car door is automatically unlocked only when the elevator car is disposed at the level of a floor, i.e. when the car door stands opposite a shaft door of the elevator.

For this purpose, one of the entraining runners has a scanning runner in the region of the outwardly disposed runner surface of that entraining runner, i.e. the runner surface co-operating with the corresponding coupling element at the shaft door leaf (coupling roller). This scanning runner extends parallel to the entraining runner and is so connected therewith by means of guide springs that in the unloaded state it is spaced a few millimeters therefrom. The contact force exerted by the coupling element on the scanning runner during a coupling process (entrainer spreading) causes displacement thereof against the spring force of the guide springs in direction towards the entraining runner. The scanning runner has a cam which transmits its displacement, which is produced by the coupling element, relative to the entraining runner and thus relative to the car door leaf to a car door lock mounted at this car door leaf and unlocks the car door leaf. If a door opening command and a resulting spreading of the entraining runners of the coupling mechanism take place when the door of the elevator car does not stand opposite a shaft door, then the entraining runners as also the scanning runner do not come into contact with one of the coupling elements at the shaft door leaves. The scanning runner is therefore not displaced relative to the entraining runner and the car door lock remains in its locking setting. A sensor monitoring the setting of the car door lock additionally prevents switching-on of the door drive motor.

This door drive device has some disadvantages.

The most significant disadvantage is that two runners, namely an entraining runner and the scanning runner guided thereat, are required on one side of the coupling mechanism. This has, on the one hand, the consequence of a high material and production cost. On the other hand, technical disadvantages result therefrom, such as losses in precision and large masses to be moved.

A further disadvantage is the relatively imprecise guidance of the scanning movement of the scanning runner by the guide springs, which requires a correspondingly larger scanning path for compensation. The limited stability of the scanning runner guidance by guide springs in the case of eccentric action of force on the scanning runner has the consequence of additional inaccuracies and thus a larger necessary scanning path. This is particularly the case when the coupling element due to variable spacing between elevator car and shaft door engages only in the lateral edge region of the scanning runner. However, larger travel paths increase the bending stresses in the guide springs and thus the risk of spring breakages.

The present invention has the object of creating equipment of the afore-described kind, which does not have the stated disadvantages.

SUMMARY OF THE INVENTION

The advantages achieved by the present invention are that coupling equipment on the scanning side has an entraining runner which produces the entrainment of the coupling element and at the same time picks up (detects) the presence of a coupling element and in the case of the presence of a coupling element unlocks the car door lock. The entraining runner is connected by articulation members with two adjusting elements, wherein the articulation members are so constructed and arranged that a contact force exerted by the coupling elements on the entraining runner produces a secure and precisely guided additional movement of the articulation members and the entraining runner. By the expression "secure and precisely guided additional movement" there is meant on the one hand that the risk of a guide spring breakage is eliminated by the articulation members and on the other hand that the articulation members guide the additional movement more precisely and stably than is possible by the resilient guide springs according to the state of the art.

According to a preferred form of embodiment of the equipment according to the present invention a drive element, which drives the opening and closing movement of the door leaf, or a separate door coupling drive produces the pivot movement of the one adjusting element, wherein a synchronous pivot movement of the other adjusting element is ensured by an entraining runner directly mounted on corresponding lever arms of the two adjusting elements. This construction allows a parallelogram-like articulated mounting of the scanning entraining runner on the two other corresponding lever arms of the adjusting elements.

For the drive of very heavy door leaves and in the case of increased demands concerning lack of noise it can be advantageous to produce the pivot movement of the adjusting elements by a separate door coupling drive, for example by a spindle stroke motor or a geared motor.

Advantageously the articulation members connecting the entraining runners with the pivotable adjusting elements are pivotably mounted at the ends of corresponding lever arms of the two adjusting elements and so arranged that the pivot angles of the pivot movements able to be executed between the adjusting elements and the articulation members are mechanically limited.

Advantageous conditions for conversion of the contact force between coupling element and first entraining element into a pivot motion result when the pivot movement of the articulation members is so limited that its articulation member axis, which is defined by the connecting line between its bearing points, is oriented at an angle of 20° to 60° relative to the longitudinal axis of the entraining runners when the adjusting elements are disposed in coupling setting and the first entraining runner is not loaded by a coupling element.

Preferably, the pivot angles of the pivot movements able to be executed between the adjusting elements and the articulation members lie between 10° and 60°. Depending on the respective length of the articulation members, favorable entrainer movements for unlocking of the lock result in this pivot angle range.

In advantageous manner the mechanical limitation of the pivot angles takes place in that at least one of the articulation members has two respective abutments which are arranged around the pivot axle connecting the members with the respective adjusting element and which in the respective limiting positions impinge on corresponding abutments at the adjusting element.

In the case of the preferred form of embodiment of the present invention, when the coupling setting of the adjusting elements is present and the action of a contact force by the coupling element on the entraining runner mounted at the articulation members is absent the articulation members and the entraining runner connected therewith adopt in consequence of their weight or a spring force a weight-centered or spring-centered setting which is defined by one of the abutments and in which none of the components of the equipment act on the car door lock. It is thus achieved that no unlocking of the car door takes place when the entraining runners in the coupling process (entrainer spreading) do not come into contact with a coupling element of the shaft door. This is the case when the elevator car as a consequence of an operational fault is not correctly disposed at the level of a floor. The adjusting elements, articulation members and first entraining runner are so shaped and arranged that when the coupling setting of the adjusting element is present the articulation members adopt a setting which has the effect that a contact force acting by the coupling element on the first entraining runner pivotably connected therewith causes an additional movement of the articulation members and the entraining runner, in the course of which one of the components of the equipment unlocks a lock of the car door lock.

According to a preferred form of embodiment of the present invention the entraining runner mounted at the articulation member or an unlocking member connected therewith unlocks the lock at the car door lock. This has the advantage that the position of the lock along the relatively long entraining runner can vary.

According to an advantageous embodiment of the present invention the lock of the car door lock is a double-armed lever which is pivotable about an axle connected with the car door leaf and has at one arm a hook co-operating with a locking abutment and which carries at the other arm a roller by way of which it is moved out of the engagement with the locking abutment by the entraining runner or an unlocking vane connected therewith. This embodiment of the lock makes it possible to convert the additional movement of the first entraining runner into an unlocking movement of the lock in optimum manner and with low friction losses.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1A:
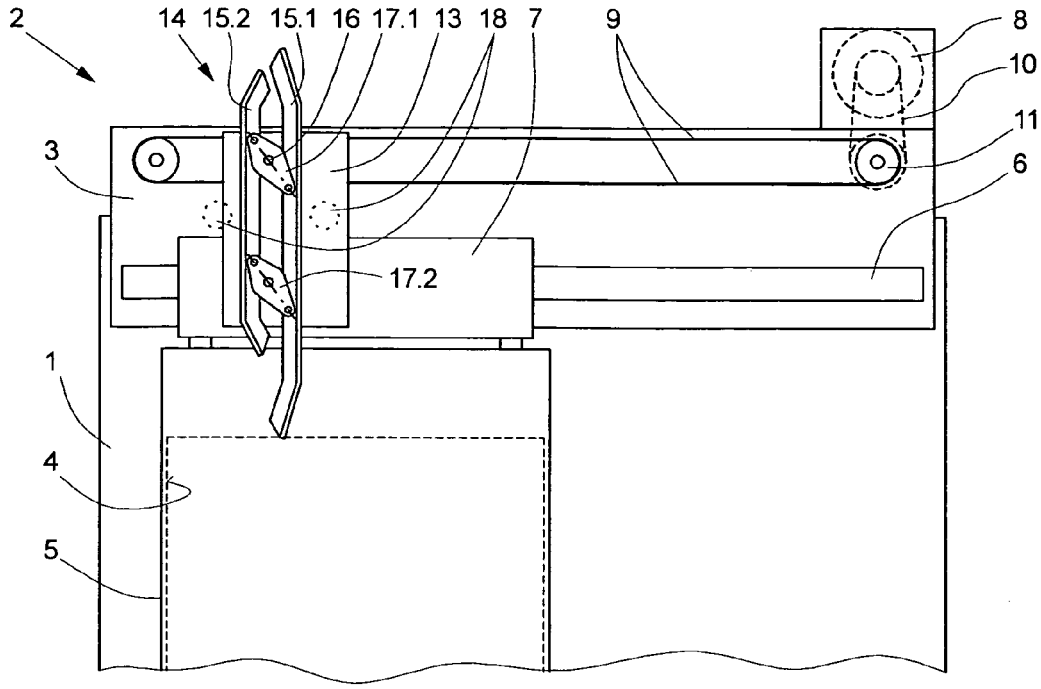
FIG. 1A is a fragmentary schematic elevation view of an elevator car with an elevator door drive device for a laterally closing single-leaf door, with a coupling mechanism having unspread entraining runners, but without a mechanism for unlocking the car door.
Figure 1B:
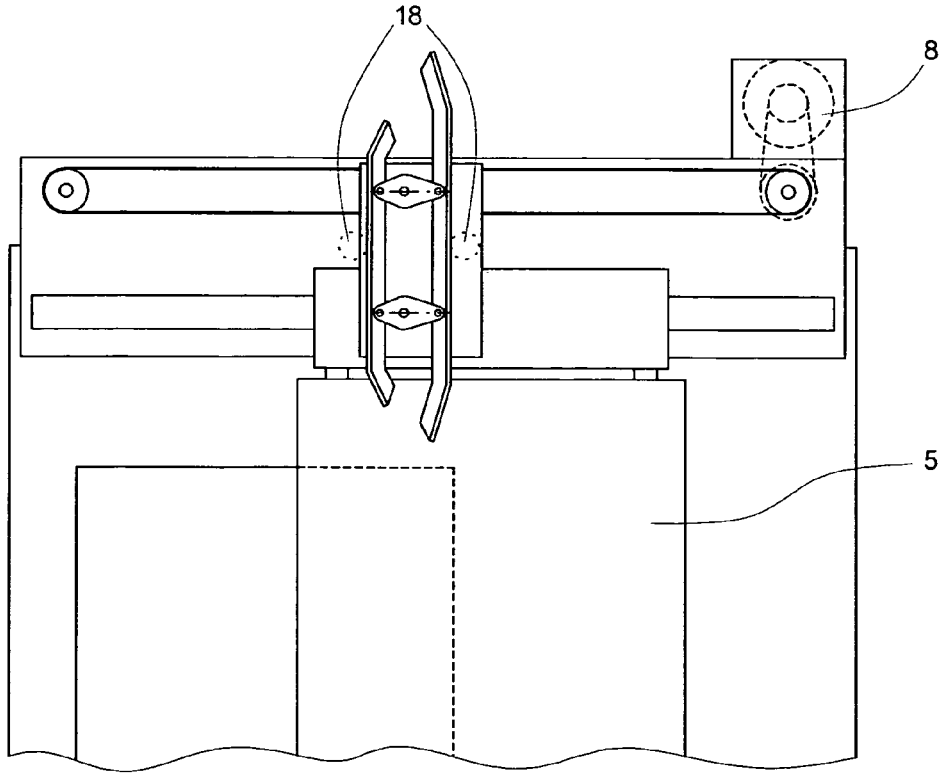
FIG. 1B is a view of the elevator car according to FIG. 1A with the coupling mechanism having spread entraining runners.

FIGS. 1A and 1B schematically show an elevator door drive device 2, which is mounted at an elevator car 1, for a laterally closing single-leaf door. The elevator car 1 has a door opening 4, which is closable by a car door leaf 5. The elevator door drive device 2 is installed on a door support 3 fastened to the elevator car 1. The door leaf 5 is fastened to a suspension carriage 7 which is laterally displaceable along a guide rail 6 fixed to the door support and which is moved between a door leaf opening setting and a door leaf closed setting by a drive unit 8 via a linearly acting, circulating drive means 9. An electric motor, which drives a drive pulley 11 of the linearly acting drive means 9 at regulated or unregulated rotational speed by way of a transmission 10, can serve as the drive unit 8. The linearly acting drive means 9 can be a cogged belt, a flat belt, a V-belt or also a roller chain. A base plate 13, on which a coupling mechanism 14 for transmitting the movement of the car door leaf to a shaft door leaf (not visible) associated therewith is installed, is fastened to the suspension carriage 7. The coupling mechanism 14 comprises two entraining runners 15.1, 15.2 oriented to be parallel to the direction of travel of the elevator car and mounted on two adjusting elements 17.1, 17.2, which are each pivotable about a respective pivot axle 16 and are adjustable, by such pivoting, in their mutual spacing, i.e. can adopt an unspread or a spread setting. Two coupling elements 18—here in the form of coupling rollers—are present each time at the shaft door leaves of all floor doors and protrude so far into the shaft space near the entraining runners 15.1, 15.2 that these in the spread state can transmit laterally (horizontally) directed forces and movements to the coupling elements 18 and the corresponding shaft door leaf insofar as the elevator car 1 is disposed in the region of a floor level. The shaft door leaves associated with the illustrated car door leaves 5 are, for reasons of clarity, not visible in all figures which are present and the coupling elements (coupling rollers) 18 mounted at the shaft door leaves are therefore illustrated only by means of so-termed phantom lines.

Pivoting of the adjusting elements 17.1, 17.2 and thus adjusting of the spacing between the entraining runners 15.1, 15.2 similarly takes place by the drive unit 8 via the linearly acting drive means 9. The operating principle of the adjustment of spacing (spreading) is explained in connection with FIG. 2.

FIG. 1A shows the setting of the coupling mechanism 14 during travel of the elevator car 1, i.e. with closed car and shaft door leaves. In this situation the entraining runners 15.1, 15.2 adopt their uncoupling setting (unspread setting) in which they can move through in vertical direction between the coupling elements 18 mounted adjacent to one another at the shaft door leaves.

FIG. 1B shows the situation in which the elevator car 1 is disposed at the level of a floor opposite a shaft door and the entraining runners 15.1, 15.2 have been spread (coupling setting), so that these come into contact with the two coupling elements 18 at the shaft door leaf and in co-operation with these coupling elements 18 form a play-free coupling between the car door leaf 5 and the associated shaft door leaf. In the illustrated situation the drive unit 8 has already partly opened the car door leaf 5 and, with this, also the associated shaft door leaf. Unlocking of the shaft door leaf, which is not further described here, usually takes place at the beginning of the door opening process by the action of the entraining runners 15.1, 15.2 on at least one of the coupling elements 18.

Figure 2:
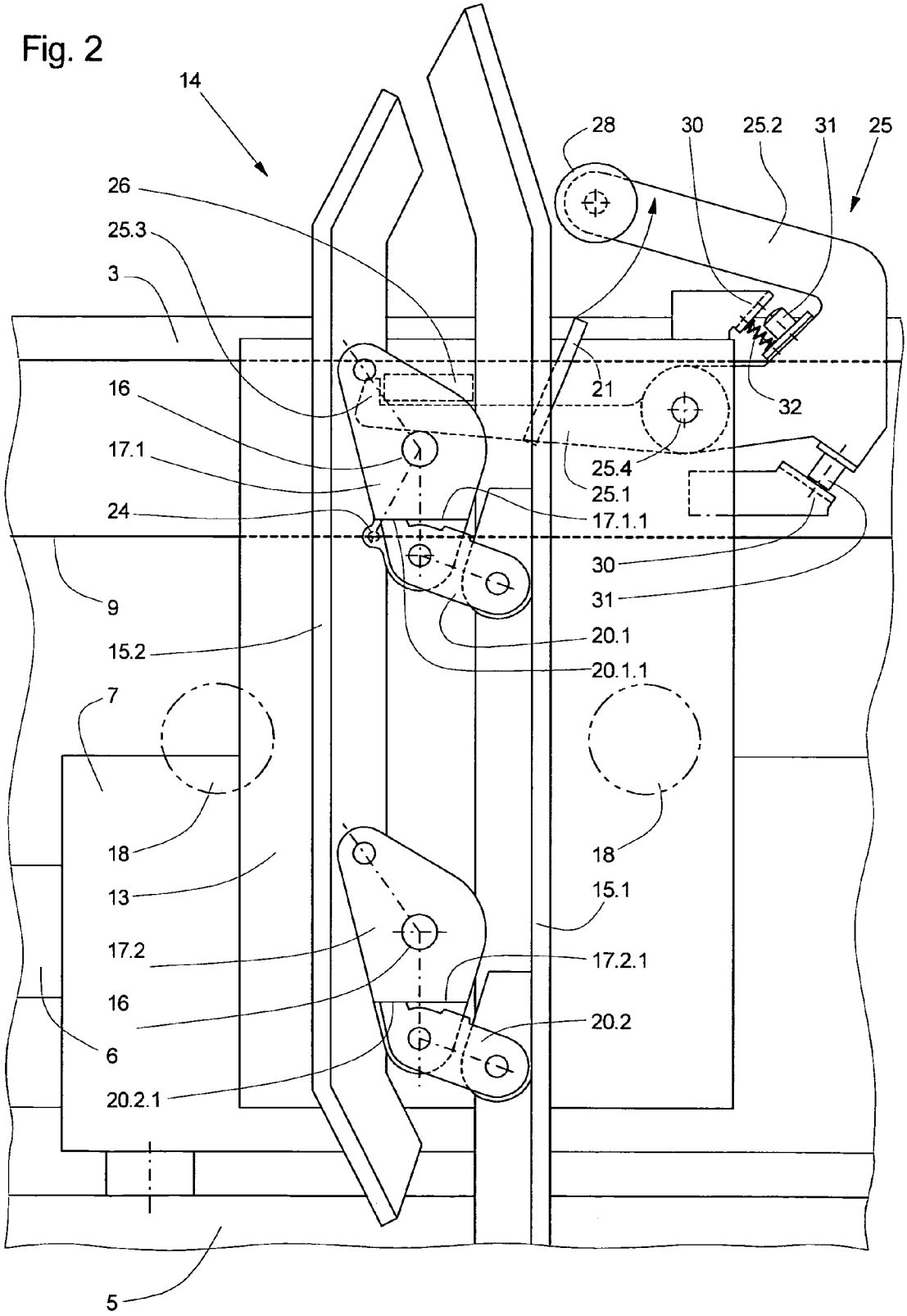
FIG. 2 is an enlarged view of the coupling mechanism according to FIGS. 1A and 1B, in an uncoupling setting, with coupling elements of the shaft door (coupling rollers) in the region of the entraining runners, with a mechanism for unlocking the lock of a car door lock, as well as with the lock.
Figure 3:
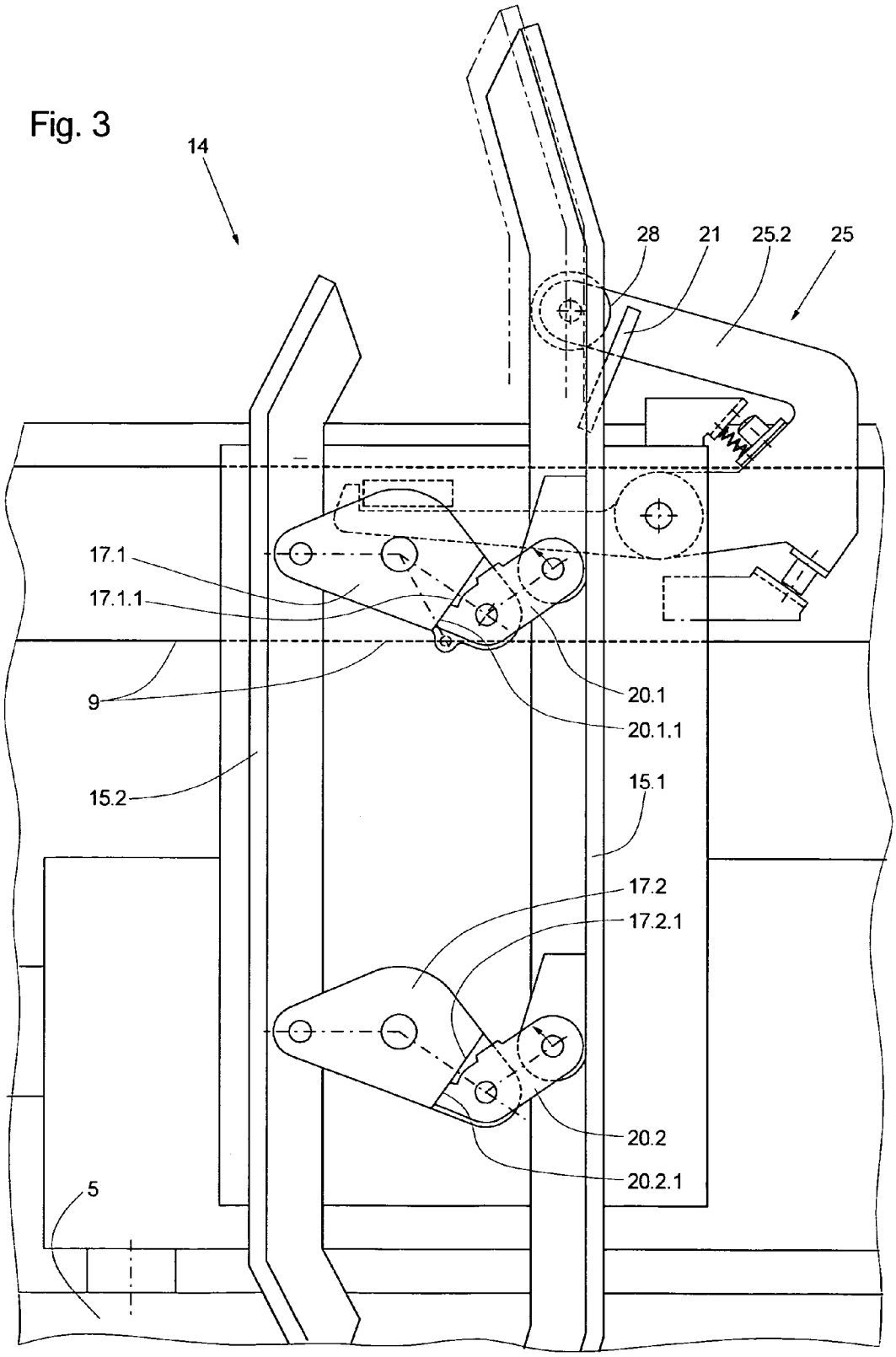
FIG. 3 is a view similar to FIG. 2, but with the coupling mechanism in a coupling setting, the coupling elements of the shaft door not in the region of the entraining runners and the lock in a locked setting.
Figure 4:
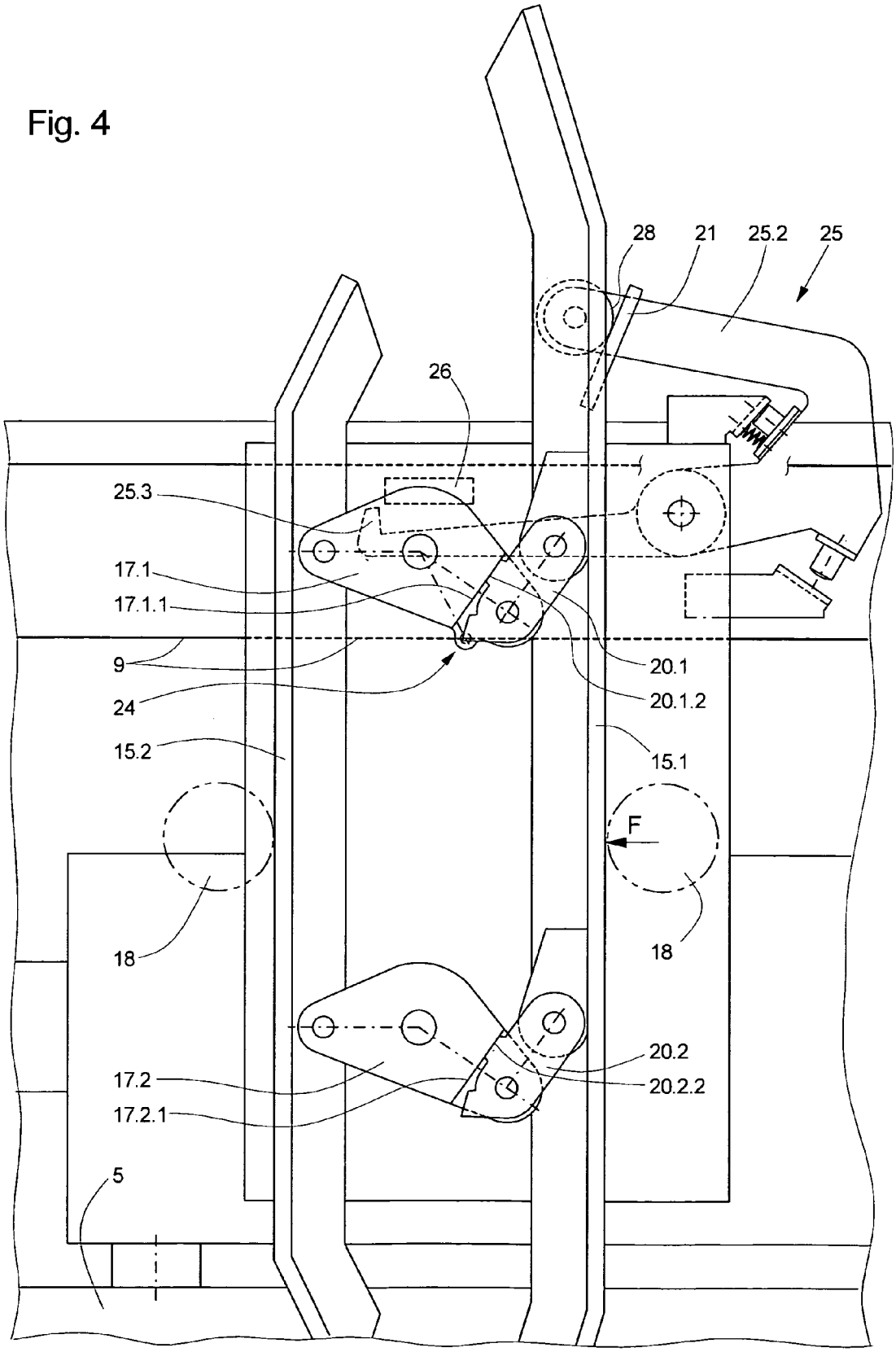
FIG. 4 is a view similar to FIG. 3, but with the coupling elements of the shaft door (coupling rollers) bearing against the entraining runners and the lock in an unlocked setting.

FIGS. 2, 3 and 4 show, on the basis of detail views, the critical settings and thus the manner of operation of the equipment according to the present invention, which on the one hand contains the coupling mechanism 14 described in connection with FIGS. 1A and 1B and on the other hand an additional mechanism for unlocking a car door lock.

FIG. 2 shows the equipment in its initial setting in which the car door leaf 5 is closed and locked and the entraining runners 15.1, 15.2 adopt their unspread setting in which they are spaced at a maximum relative to the coupling elements 18 of the shaft doors. As already mentioned, the base plate 13, on which the coupling mechanism 14 for transmission of the movement of the car door leaf to the shaft door leaf (not visible) associated therewith is mounted, is fastened on the suspension carriage 7 carrying the car door leaf 5 and guided at the guide rail 6. A lock 25 of the car door lock is mounted on the rear side of the base plate 13 to be pivotable about a lock bearing 25.4. In the present example this is constructed as a double-armed lever with a locking arm 25.1 and an unlocking arm 25.2. The locking arm 25.1 has at its end a hook 25.3 by way of which the lock 25 in the locked state of the base plate 13 and thus the car door leaf 5 is coupled with a locking abutment 26. This blocking abutment 26 is fixed on the door support 3 fixedly connected with the elevator car 1. An unlocking roller 28 is mounted at the unlocking arm 25.2.

The pivot movement of the lock 25 is limited in both directions by means of lock abutments 30 and resilient lock buffers 31 and is biased in the direction of the locking setting of the lock by means of a restoring spring 32.

The coupling mechanism 14 transmitting the opening and closing movement of the car door leaf 5 to the corresponding shaft door leaf substantially comprises the following components:

the first entraining runner 15.1 and the second entraining runner 15.2;

the two double-armed adjusting elements 17.1, 17.2, which are each fixed on the respective pivot axle 16 mounted on the base plate 13 and which are pivoted by the mentioned linear drive means 9 in correspondence with the respective situation;

two articulation members 20.1, 20.2, of which each forms a pivot connection between a respective one of the arms of the two adjusting elements 17.1, 17.2 and the first entraining runner 15.1; and an unlocking vane 21 which is fixedly connected with the first entraining runner 15.1 and which transmits an unlocking movement (additional movement) of the entraining runner 15.1 to the unlocking roller 28, which is mounted at the second arm 25.2 of the lock 25, of the car door lock.

Before the start of a door leaf opening process, i.e. in the situation illustrated in FIG. 1 with closed car and shaft doors, the linearly acting drive means 9 exerts by way of a connecting point 24 a closing force, which is directed towards the left, on the adjusting element 17.1 or an auxiliary element connected therewith, which has the effect that the adjusting element 17.1 seated on the pivot axle 16 adopts a setting in which the entraining runners 15.1, 15.2 are spaced apart as little as possible (not spread setting) and have a sufficient spacing from the coupling elements 18 at the shaft door leaf. The second adjusting element 17.2 is rigidly coupled by way of the second entraining runner 15.2 with the first adjusting element 15.1 and therefore adopts every time the same setting as the latter. The said closing force acts against—here not shown—abutments, of which one defines the unspread position of the entraining runners 15.1, 15.2 and a second limits the closing movement of the entire coupling mechanism 14 with the car door leaf 5.

The first entraining runner 15.1 is pivotably connected by way of the two articulation members 20.1, 20.2 with two corresponding arms of the two adjusting elements 17.1 and 17.2, i.e. no direct connection exists between these two arms of the adjusting elements. The articulation members in this situation adopt a setting which is defined by the co-operation of adjusting element abutments 17.1.1, 17.2.1 with first articulation member abutments 20.1.1 and 20.2.1 and by the weight force of the entraining runner 15.1 and in which a horizontal force acting on the entraining runner 15.1 cannot produce an additional movement.

At the beginning of the door leaf opening process the linearly acting drive means 9 coupled at the connecting point 24 with the adjusting element 17.1 moves to the right so that the adjusting elements 17.1, 17.2 begin to rotate—assisted by a spreading spring (not illustrated)—in a counter-clockwise sense. The entraining runners 15.1, 15.2 are thereby spread apart. As soon as the entraining runners 15.1, 15.2 have reached their maximum spread setting, the adjusting elements 17.1, 17.2 and the entraining runners are blocked by a—here not illustrated—mechanism so that the force of the drive means 9 is transmitted to the entire coupling mechanism 14 and thus also to the car door leaf 5.

FIG. 3 shows the situation described in the foregoing, in which the entraining runners 15.1, 15.2 are completely spread, wherein, however, these are not brought into contact with the coupling elements of the shaft door leaf because the door opening process has, as a consequence of an operational disturbance, been taken into a situation in which the elevator car has not been disposed in the region of the floor level. The articulation members 20.1, 20.2 are now located in a setting which is defined by the pivot movement, which has taken place, of the adjusting elements 17.1, 17.2 and always still by the first articulation member abutments 20.1.1, 20.2.1 and the adjusting element abutments 17.1.1, 17.2.1. In this setting the entraining runner 15.1 is, as a consequence of the pivot movement of the adjusting elements, raised to a height at which the unlocking vane 21 fixed thereat could actuate the unlocking roller 28 mounted at the unlocking arm 25.2 of the lock 25. However, since no contact force exerted by coupling elements horizontally on the entraining runner 15.1 is present the entraining runner and the unlocking vane 21 remain laterally spaced too far from the unlocking roller 28, which has the consequence that the lock 25 remains in its locking setting and prevents movement of the car door leaf 5.

FIG. 4 shows the equipment according to the present invention in the situation in which the entraining runners 15.1, 15.2 in the course of the spreading process are brought into contact with the coupling elements 18, i.e. in which the door opening process has been taken into a situation in which the elevator car has been correctly disposed in the region of a floor level. As a consequence of the pivot movement of the adjusting elements 17.1, 17.2 the articulation members 20.1, 20.2 pivotably mounted thereat have reached a position in which the bearing points present between the first entraining runner 15.1 and the articulation members lie so far above the bearing points connecting the articulation members with the adjusting element 17.1, 17.2 that a contact force F exerted by the coupling element 18 on the entraining runner 15.1 and the articulation members has been able to pivot the articulation members 20.1, 20.2 in counter-clockwise sense (starting position before the pivoting shown in FIG. 3). The travel of this pivot movement, by which the entraining runner 15.1 has executed an additional movement, is limited by impinging of the second articulation member abutments 20.1.2, 20.2.2 on the adjusting element abutments 17.1.1, 17.2.1. The additional movement of the entraining runner 15.1 thus has the effect that the unlocking vane 21 fastened thereat has displaced the unlocking roller 28, which is mounted at the unlocking arm 25.2 of the lock 25, to the left, whereby the lock 25 has been pivoted in a counter-clockwise sense so that in the situation illustrated in FIG. 4 the hook 25.3 is no longer disposed in engagement with the locking abutment 26. The car door lock 25 is thus unlocked and the linearly acting drive means 9 can move this in common with the shaft door leaf, which is coupled thereto, into the open setting.

In the subsequent door leaf closing process the drive means 9 connected by way of the connecting point 24 with the first adjusting element 17.1 blocked by a mechanism moves to the left. As a consequence of the action of the blocking mechanism, which is not illustrated here, the entraining runners 15.1, 15.2 remain spread during closing movement of the door leaf and the lock of the car door lock remains unlocked. Shortly before the car door leaf 5 has reached its closed setting the action of the mechanism blocking the setting of the adjusting element 17.1 is cancelled and the drive means 9 pivots the adjusting elements and the entraining runners back into the initial setting described in the foregoing in connection with FIG. 2. The entraining runners in that case move away from the coupling elements 18 and the unlocking vane 21 connected with the first entraining runner 15.1 frees the unlocking roller 28, so that the lock 25 returns to its locking setting. Monitoring sensors, which are not illustrated here, at the lock 25 and at the shaft door locks signal to the elevator control that the elevator car can now move away from the door region.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. Equipment on an elevator car for temporarily coupling a car door leaf with a shaft door leaf and for actuating a car door lock comprising:

a pair of adjusting elements pivotably mounted at a car door leaf;

first and second entraining runners connected with said adjusting elements wherein a mutual spacing of said entraining runners can be adjusted by pivoting said adjusting elements between an uncoupling setting and a coupling setting, said entraining runners in the coupling setting being adapted to co-operate with at least one coupling element which is mounted at the shaft door leaf and which exerts a contact force on one of said entraining runners; and a pair of articulation members each pivotably connected with one arm of an associated one of said adjusting elements and with said first entraining runner, whereby the contact force causes said first entraining runner to execute an additional movement which is securely and precisely guided by said articulation members and which causes unlocking of the car door lock.

2. The equipment according to claim 1 wherein said adjusting elements each have another arm being mounted on said second entraining runner.

3. The equipment according to claim 1 including a door drive means connected to one of said adjusting elements for pivoting said adjusting elements.

4. The equipment according to claim 3 wherein said door drive means is adapted to drive opening and closing movements of the car door leaf and the shaft door leaf.

5. The equipment according to claim 1 wherein said articulation members are pivotably mounted at ends of corresponding ones of said one arms of said adjusting elements and mechanically limit pivot angles of the pivoting movements executed between said adjusting elements and said articulation members.

6. The equipment according to claim 5 wherein the pivoting movements are limited such that an articulation member axis defined by a connecting line between bearing points is oriented at an angle in a range of 20° to 60° relative to a longitudinal axis of said entraining runners when said adjusting elements are disposed in the coupling setting and said one entraining runner is not loaded by the coupling element.

7. The equipment according to claim 5 wherein the pivot angles of the pivoting movements between said adjusting elements and said articulation members is in a range of 10° to 60°.

8. The equipment according to claim 1 wherein at least one of said articulation members includes two abutments which are arranged around a pivot axle connecting said at least one articulation member with a respective one of said adjusting elements and wherein said two abutments in respective limiting positions impinge upon corresponding abutments on said respective one adjusting element.

9. The equipment according to claim 1 wherein in the coupling setting of said adjusting elements and in the absence of the contact force, said articulation members and said associated one entraining runner adopt a centered setting which does not cause unlocking of the car door lock.

10. The equipment according to claim 9 wherein in the presence of the contact force, said articulation members and said associated one entraining runner make the additional movement to unlock the car door lock.

11. The equipment according to claim 1 wherein said first entraining runner contacts the door lock upon executing the additional movement.

12. The equipment according to claim 1 including an unlocking vane connected to said first entraining runner and wherein said unlocking vane contacts the door lock upon executing the additional movement to unlock the car door lock.

13. The equipment according to claim 1 wherein the car door lock includes a double-armed lever pivotable about an axle connected with the car door leaf, said lever having one arm with a hook co-operating with a locking abutment on the car door, another arm of said lever having a roller for contact with said first entraining runner to move said hook out of the engagement with the locking abutment.

14. The equipment according to claim 13 including an unlocking vane connected to said first entraining runner and wherein said unlocking vane contacts said roller to unlock the car door lock.

* * * * *